US006988964B2

(12) United States Patent
Buckfield

(10) Patent No.: US 6,988,964 B2
(45) Date of Patent: Jan. 24, 2006

(54) YARD GAME THAT USES BALLS AND RINGS

(75) Inventor: Andrew William Buckfield, Ferndale, MI (US)

(73) Assignee: Letter 22, LLC, Ferndale, MI (US)

( * ) Notice: Subject to any disclaimer, the term of this patent is extended or adjusted under 35 U.S.C. 154(b) by 0 days.

(21) Appl. No.: 10/715,949

(22) Filed: Nov. 18, 2003

(65) Prior Publication Data

US 2005/0104295 A1 May 19, 2005

(51) Int. Cl.
*A63B 67/00* (2006.01)
*A63B 61/00* (2006.01)

(52) U.S. Cl. ..... 473/415; 473/490

(58) Field of Classification Search ..... 473/415, 473/470, 490, 588, 589; 273/317, 317.1, 273/336–348

See application file for complete search history.

(56) References Cited

U.S. PATENT DOCUMENTS 2,432,824 A * 12/1947 Shetler ..... 273/336
2,545,615 A * 3/1951 Hatley ..... 473/476
3,403,907 A * 10/1968 Keller ..... 273/350
4,183,530 A * 1/1980 Roop ..... 273/247
4,805,916 A * 2/1989 Zentner, Jr. ..... 273/336
4,898,392 A * 2/1990 Goletz ..... 273/336
5,125,669 A * 6/1992 Kanda ..... 273/348
5,211,394 A * 5/1993 Jackson et al. ..... 273/317.6
5,275,404 A * 1/1994 Dimaano et al. ..... 473/180
5,421,585 A * 6/1995 Ruvio ..... 273/338
5,741,194 A * 4/1998 Simunek ..... 473/490
5,799,938 A * 9/1998 Lewis ..... 273/118 R
5,863,265 A * 1/1999 Acton ..... 473/470
5,938,202 A * 8/1999 Williams ..... 273/336
6,237,918 B1 5/2001 Williams
6,386,997 B1 * 5/2002 Brown ..... 473/490
6,506,123 B1 * 1/2003 Weidlich ..... 473/180
6,575,855 B1 * 6/2003 Buzak et al. ..... 473/569
2003/0054896 A1 * 3/2003 Weidlich ..... 473/187
2003/0098545 A1 * 5/2003 Webb ..... 273/343
2004/0077255 A1 * 4/2004 Tarng et al. ..... 446/46

OTHER PUBLICATIONS

Toypedo Pop-a-Ring Target Game; www.iqkids.net.*
IQ Kids—Deluxe Diviing Fun Rings; www.iqkids.net.*

* cited by examiner

*Primary Examiner*—Mitra Aryanpour
(74) *Attorney, Agent, or Firm*—Price, Heneveld, Cooper, DeWitt & Litton, LLP

(57) ABSTRACT

A method of playing a game comprises a number of steps. Initially, boundaries of a playing field are marked with the playing field including a plurality of playing zones, with at least one end of the playing field acting as a throwing line. The game is initiated by projecting a first throwing ring from behind the throwing line toward the playing field and into one of the playing zones. A second throwing ring is also projected from behind the throwing line toward the playing field and into one of the playing zones. At least one first ball and at least one second ball are projected from behind a throwing line toward at least one of the first and second throwing rings. Finally, points are assigned based upon the position of the first and second balls in relationship to the first and second throwing rings.

20 Claims, 3 Drawing Sheets

YARD GAME THAT USES BALLS AND RINGS

BACKGROUND OF THE INVENTION

The present invention is generally directed to a game and, more specifically, to a game that utilizes throwing rings and balls. A number of games exist that test the skill of a player to direct throwing rings or balls in relationship to other objects. For example, such games as lawn bowling, horseshoes, boccie ball and croquet utilize at least one of the above-referenced components. The above-described games require skill and practice to develop one's game but, in general, require little strategy.

It would be desirable to develop a yard game that uses balls and throwing rings that requires strategy, as well as skill.

SUMMARY OF THE INVENTION

The present invention is directed to a method of playing a game comprising a number of steps. Initially, boundaries of a playing field are marked to provide a playing field with a plurality of playing zones, with at least one end of the playing field acting as a throwing line. The playing zones are arranged sequentially and each of the playing zones may have a different associated point value. The game is initiated by projecting a first throwing ring from behind the throwing line toward the playing field and into one of the playing zones. A second throwing ring is also projected from behind the throwing line toward the playing field and into one of the playing zones. Next, at least one first ball is projected from behind a throwing line toward at least one of the first and second throwing rings, with the first ball being associated with the first throwing ring. Also, at least one second ball is projected from behind the throwing line toward at least one of the first and second throwing rings, with the second ball being associated with the second throwing ring. Finally, points are assigned based upon the position of the first and second balls in relationship to the first and second throwing rings.

According to one aspect of the present invention, the plurality of playing zones includes a first playing zone (e.g., zone 0), a second playing zone (e.g., zone 1), a third playing zone (e.g., zone 2) and a fourth playing zone (e.g., zone 3). According to another embodiment of the present invention, the at least one first ball includes three of the first balls and the at least one second ball includes three of the second balls. According to this aspect, the points are assigned only when one of the first balls is closer to the first throwing ring than one of the second balls and one of the second balls is closer to the second throwing ring than one of the first balls.

According to a different aspect of the invention, the point value of the first playing zone is zero. According to still another aspect of the present invention, the point value of the second playing zone is one, the point value of the third playing zone is two and the point value of the fourth playing zone is three, when the first ball is within a predetermined distance of the first throwing ring and the second ball is within a predetermined distance of the second throwing ring.

According to another embodiment of the present invention, the predetermined distance is about two feet, six inches. According to still another aspect of the present invention, the point value of the second playing zone is two, the point value of the third playing zone is four and the point value of the fourth playing zone is seven, when the first ball is within the first throwing ring and the second ball is within the second throwing ring.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
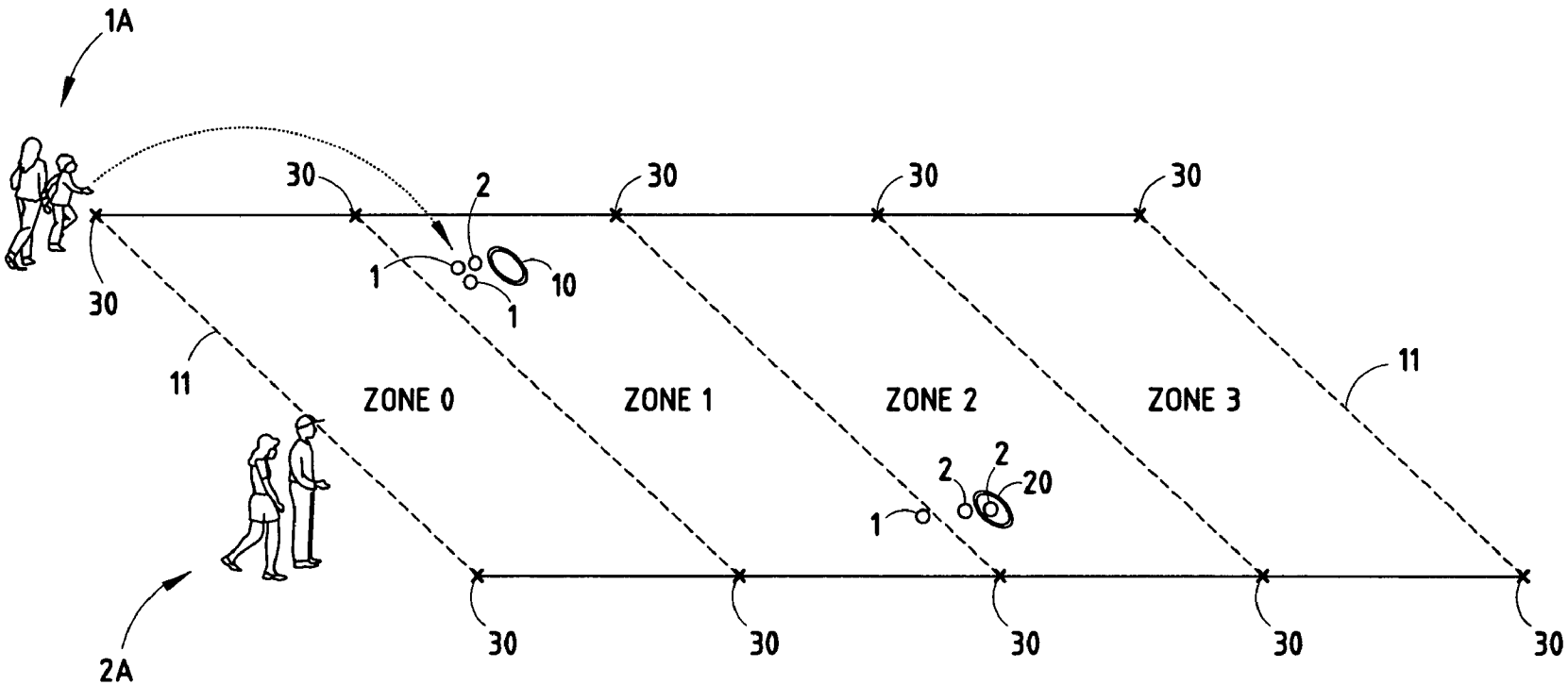
FIG. 1 is an exemplary field layout depicting exemplary locations of first and second throwing rings and a plurality of first and second balls in relationship to the throwing rings.

A playing field for a game played according to the present invention may be constructed with ten field markers (see FIGS. 1–3) that are arranged to mark the boundaries of the playing field and four playing zones. Alternatively eight field markers may be utilized to mark the boundaries of the playing field by utilizing only one centrally located field marker at either end of the field. In one embodiment, six balls and two throwing rings may be utilized. It should be appreciated that a game according to the present invention may utilize a playing field with a different configuration and more or less than six balls and more than two throwing rings may be used, if desired. When six balls are utilized, three of the balls may be marked with a color that matches one of the throwing rings and the remaining three balls may be marked with a different color that matches the color of the remaining one of the throwing rings, such that it can be readily determined to which individual and/or team the balls and the throwing rings are assigned. Alternatively, the throwing rings and balls may be numbered. For example, three of the balls and one of the throwing rings may be labeled with the number '1' and the remaining three balls and the remaining throwing ring may be labeled with the number '2'. Thus, according to one embodiment of the present invention, each team or individual plays with one throwing ring and three balls.

According to another aspect of the invention, the game is played until one team reaches a total of 21 points, by a margin of 2 points. According to this aspect, two teams compete with two players per team, with both teams throwing from the same throwing line on a given rotation. According to this embodiment, any tie goes to the defensive team, i.e., a team that has thrown one or more balls at an opponents throwing ring.

According to one aspect of the invention, the team that throws their throwing ring first also throws one of their balls first. The teams take turns throwing the throwing rings and then each team throws one ball at a time until all six balls are played. According to this aspect, the team with the lesser total number of points always throws second. In this embodiment, a throwing ring that lands between scoring zones is accorded the value of the lesser scoring zone. A game rotation involves both teams throwing their respective throwing rings and three balls and adding up the scores and walking across the field to the opposite throwing line, at which point a new game rotation is started.

According to the present invention, a team can play offense and defense during the same game rotation. A team plays defense by throwing their ball toward their opponent's ring and plays offense by throwing their ball toward their own ring. Thus, it is possible to negate an opponent's points and gain points during the same game rotation. However, a team can only gain points by throwing a ball toward their own throwing ring. A team plays offense by throwing a ball within a predetermined distance, for example, 2 feet, 6 inches, of their throwing ring to receive a designated point value.

According to one aspect of the game, a ball thrown inside the team's own throwing ring receives approximately double the points as a ball thrown within a predetermined distance of the throwing ring. The team that throws one of their balls inside or within a predetermined distance of the opponent's throwing ring and closer to the throwing ring than all the opponent's balls negates all points the opponent may have received on the game rotation. In the event that a team wishes to play both offense and defense on the same rotation, the team may throw their throwing ring at their opponent's throwing ring in an attempt to land their throwing ring on the opponent's throwing ring. This can be advantageous if a team is trailing and the game is almost finished. In the event that a team wishes to play in a less aggressive manner, the team may throw their throwing ring away from the opponent's throwing ring, which will lessen the opportunity for the opponent to play defensively and, in turn, gives that team a better chance to score points.

According to one embodiment of the present invention, a first team is assigned one red colored throwing ring and three red colored balls and a second team is given one orange colored throwing ring and three orange colored balls. On any given team, the team member who throws the throwing ring only throws one ball, while the other team member throws the remaining two balls. As mentioned above, a team member may throw balls toward their own throwing ring to gain points and/or throw balls toward an opponent's throwing ring to negate the opponent's points during the game rotation. As previously mentioned, the score markers are utilized to set the boundaries of the playing field and may be set at varying widths, for example, each scoring zone may be twenty yards wide and twelve yards deep. According to another aspect of the present invention, when one or more balls of a team are in a different playing zone than their throwing ring, the points awarded are for the playing zone that the throwing ring is located in. According to one embodiment, each team uses both throwing lines and rotates from one side of the field to the other with the game rotation involving both teams throwing their respective throwing rings and three balls and adding up each team's scores and walking across the field, each team picking up their throwing rings and balls and walking to the opposite throwing line and starting the next game rotation.

With reference to FIG. 1, a playing field defined by eight score markers 30, which mark the boundaries of the playing field, is depicted. Throwing lines 11, are located at opposite ends of the playing field and run between end ones of the score markers 30. As is shown in FIG. 1, team 1A has tossed their throwing ring 10 into zone 1 and team 2A has thrown their throwing ring 20 into zone 2. As is also shown, team 2A has positioned one of its balls 2 closer to the ring 10 than the balls 1 of team 1A and, as such, have negated any points that team 1A would have received for the game rotation. Team 2A has also thrown one of the balls 2 into the ring 20 and one of the balls 2 closer to ring 20 than the ball 1 of team 1A. Thus, team 2A scores points for the ball 2 within the ring 20 and the ball 2 that is adjacent the ring 20.

Figure 2:
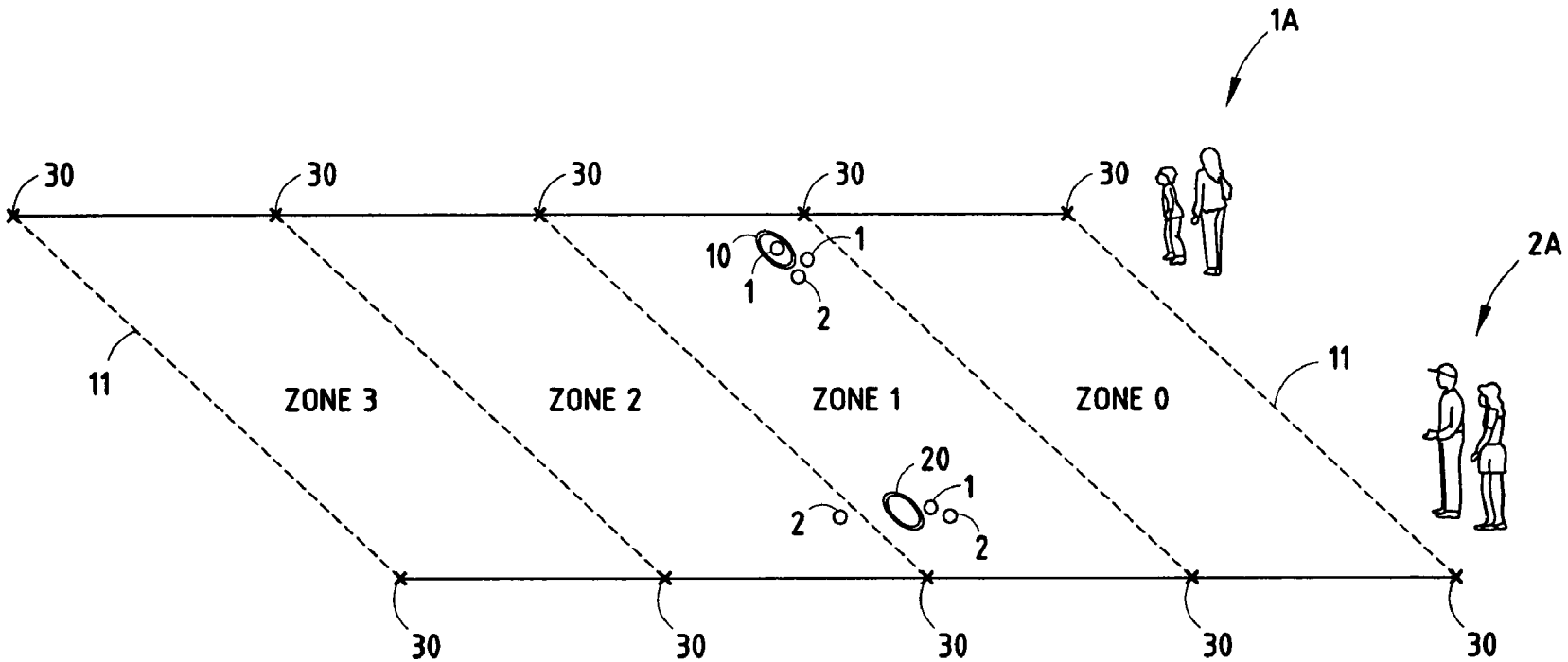
FIG. 2 is a second exemplary field layout similar to the field layout of FIG. 1, but showing different exemplary locations for the first and second throwing rings and the first and second balls.

FIG. 2 depicts the playing field of FIG. 1 in which the teams 1A and 2A have undergone a game rotation and have rotated to an opposite end of the field. As is shown in FIG. 2, the teams 1A and team 2A has both thrown their throwing rings 10 and 20, respectively, into zone 1. In this rotation, the team 1A has landed one of their balls inside of the ring 10 but has failed to roll one of the balls 1 closer to the ring 10 than one of the balls 2 thrown by the team 2A. However, the team 1A scores points for the ball 1 that is located within the ring 10 and the ball 1 that is located outside the ring 10 within a predetermined distance of the ring 10 as the ball 2 is not closer to the ring 10 than the ball 1 within the ring 10. During this round, team 1A has also managed to place one of the balls 1 closer to the ring 20 than the balls 2 thrown by the team 2A and, as such, the team 2A is not assigned any points for the round.

Figure 3:
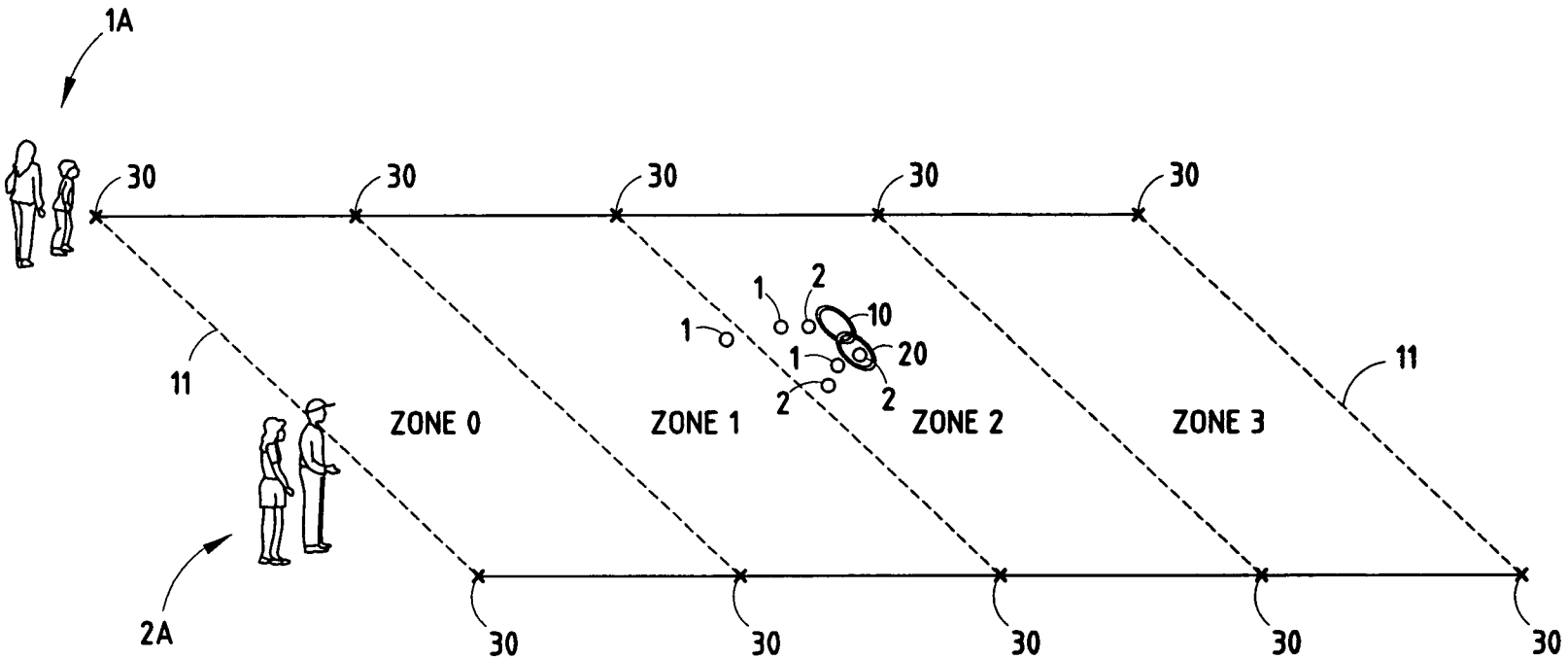
FIG. 3 is another exemplary field layout similar to the field layout of FIG. 1, but showing still different exemplary locations for the first and second throwing rings and the first and second balls.

FIG. 3 depicts the playing field following the rotation of FIG. 2, wherein the players of the teams 1A and 2A have rotated to the opposite end of the field, and thrown the rings 10 and 20 and the balls 1 and 2. As is shown in FIG. 3, both teams 1A and 2A have placed their throwing rings 10 and 20, respectively, within zone 2. As is shown, team 2A has placed one of the balls 2 within the ring 20 and has placed one of the balls 2 closer to the ring 10 than any of the balls 1 of the team 1A. In this round, the team 2A scores points for the ball 2 within the ring 20, while the team 1A does not score any points, as one of the balls 2 of the team 2A is closer to the ring 10 than any of the balls 1 of team 1A. Thus, the team 2A has played aggressively by throwing the ring 20 at the ring 10 of team 1A.

According to the various embodiments of the present invention, playing zones of the playing field may be assigned different point totals. For example, a throwing ring placed within a closest playing zone (i.e., zone 0) is accorded zero points and the team associated with the ring is forced to play defensively to negate any points that an opponent may score in a game rotation. A throwing ring placed within a next closest playing zone (i.e., zone 1) allows a team to receive one point for each ball placed within a predetermined distance of their ring and two points for each ball placed inside of their ring. A throwing ring placed within a next closest playing zone (i.e., zone 2) allows a team to receive two points for every ball placed within a predetermined distance of their ring and four points for each of their balls placed inside of their ring. If a team places their throwing ring within the farthest playing zone (i.e., zone 3), the team receives three points for every ball placed within a predetermined distance of their ring and seven points for every ball placed inside of their ring. However, as discussed above, if an opponent can place just one ball inside or closer to their opponent's throwing ring, they have successfully played defense and negated any points their opponent may have received in a game rotation.

Accordingly, a game has been described herein that uses both skill in placing throwing rings and their associated balls and strategy in determining where to throw the rings and their associated balls.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A method of playing a game, comprising the steps of:

marking boundaries of a playing field, wherein the playing field includes a plurality of playing zones with at least one end of the playing field acting as a throwing line, and wherein the playing zones are arranged sequentially;

projecting a first throwing ring from behind the throwing line toward the playing field and into one of the playing zones;

projecting a second throwing ring from behind the throwing line toward the playing field and into one of the playing zones;

projecting at least one first ball from behind the throwing line toward at least one of the first and second throwing rings, wherein the first ball is associated with the first throwing ring and a first participant;

projecting at least one second ball from behind the throwing line toward at least one of the first and second throwing rings, wherein the second ball is associated with the second throwing ring and a second participant; and assigning points based upon the position of the first and second balls in relationship to the first and second throwing rings.

2. The method of claim 1, wherein each of the playing zones has a different associated point value, and wherein the plurality of playing zones includes a first playing zone, a second playing zone, a third playing zone and a fourth playing zone.

3. The method of claim 2, wherein the at least one first ball includes three of the first balls and the at least one second ball includes three of the second balls, and wherein the points are only assigned when one of the first balls is closer to the first throwing ring than one of the second balls and one of the second balls is closer to the second throwing ring than one of the first balls, where the first participant plays defensively by throwing one or more of the first balls at the second throwing ring and the second participant plays defensively by throwing one or more of the second balls at the first throwing ring.

4. The method of claim 3, wherein the point value of the first playing zone is zero.

5. The method of claim 4, wherein the point value of the second playing zone is one, the point value of the third playing zone is two and the point value of the fourth playing zone is three when the first ball is within a predetermined distance of the first throwing ring and the second ball is within the predetermined distance of the second throwing ring.

6. The method of claim 5, wherein the predetermined distance is about two feet six inches.

7. The method of claim 4, wherein the point value of the second playing zone is two, the point value of the third playing zone is four and the point value of the fourth playing zone is seven when the first ball is within the first throwing ring and the second ball is within the second throwing ring.

8. A method of playing a game, comprising the steps of:

marking boundaries of a playing field, wherein the playing field includes a plurality of playing zones with at least one end of the playing field acting as a throwing line, and wherein the playing zones are arranged sequentially and each of the playing zones has a different associated point value;

projecting a first throwing ring from behind the throwing line toward the playing field and into one of the playing zones;

projecting a second throwing ring from behind the throwing line toward the playing field and into one of the playing zones;

projecting at least one first ball from behind the throwing line toward at least one of the first and second throwing rings, wherein the first ball is associated with the first throwing ring;

projecting at least one second ball from behind the throwing line toward at least one of the first and second throwing rings, wherein the second ball is associated with the second throwing ring; and assigning points based upon the position of the first and second balls in relationship to the first and second throwing rings.

9. The method of claim 8, wherein the plurality of playing zones includes a first playing zone, a second playing zone, a third playing zone and a fourth playing zone.

10. The method of claim 9, wherein the at least one first ball includes three of the first balls and the at least one second ball includes three of the second balls, and wherein the points are only assigned when one of the first balls is closer to the first throwing ring than one of the second balls and one of the second balls is closer to the second throwing ring than one of the first balls.

11. The method of claim 10, wherein the point value of the first playing zone is zero.

12. The method of claim 11, wherein the point value of the second playing zone is one, the point value of the third playing zone is two and the point value of the fourth playing zone is three when the first ball is within a predetermined distance of the first throwing ring and the second ball is within the predetermined distance of the second throwing ring.

13. The method of claim 12, wherein the predetermined distance is about two feet six inches.

14. The method of claim 11, wherein the point value of the second playing zone is two, the point value of the third playing zone is four and the point value of the fourth playing zone is seven when the first ball is within the first throwing ring and the second ball is within the second throwing ring.

15. A method of playing a game, comprising the steps of:

marking boundaries of a playing field, wherein the playing field includes a plurality of playing zones with at least one end of the playing field acting as a throwing line, and wherein the playing zones are arranged sequentially and each of the playing zones has a different associated point value;

projecting a first throwing ring from behind the throwing line toward the playing field and into one of the playing zones;

projecting a second throwing ring from behind the throwing line toward the playing field and into one of the playing zones;

projecting at least one first ball from behind the throwing line toward at least one of the first and second throwing rings, wherein the first ball is associated with the first throwing ring;

projecting at least one second ball from behind the throwing line toward at least one of the first and second throwing rings, wherein the second ball is associated with the second throwing ring; and assigning points based upon the position of the first and second balls in relationship to the first and second throwing rings, wherein the plurality of playing zones includes a first playing zone, a second playing zone, a third playing zone and a fourth playing zone.

16. The method of claim 15, wherein the at least one first ball includes three of the first balls and the at least one second ball includes three of the second balls, and wherein the points are only assigned when one of the first balls is closer to the first throwing ring than one of the second balls and one of the second balls is closer to the second throwing ring than one of the first balls.

17. The method of claim 15, wherein the point value of the first playing zone is zero.

18. The method of claim 15, wherein the point value of the second playing zone is one, the point value of the third playing zone is two and the point value of the fourth playing zone is three when the first ball is within a predetermined distance of the first throwing ring and the second ball is within the predetermined distance of the second throwing ring.

19. The method of claim 18, wherein the predetermined distance is about two feet six inches.

20. The method of claim 15, wherein the point value of the second playing zone is two, the point value of the third playing zone is four and the point value of the fourth playing zone is seven when the first ball is within the first throwing ring and the second ball is within the second throwing ring.

* * * * *